US007109956B2

(12) United States Patent
Fery et al.

(10) Patent No.: US 7,109,956 B2
(45) Date of Patent: Sep. 19, 2006

(54) BISTABLE ORGANIC ELECTROLUMINESCENT PANEL IN WHICH EACH CELL INCLUDES A SHOCKLEY DIODE

(75) Inventors: Christophe Fery, Rennes (FR); Jean-Paul Dagois, Cesson Sévigné (FR)

(73) Assignee: Thomson Licensing, Boulogen-Billancourt (FR)

( * ) Notice: Subject to any disclaimer, the term of this patent is extended or adjusted under 35 U.S.C. 154(b) by 496 days.

(21) Appl. No.: 10/701,644

(22) Filed: Nov. 5, 2003

(65) Prior Publication Data

US 2004/0089870 A1 May 13, 2004

(30) Foreign Application Priority Data

Nov. 5, 2002 (FR) ..... 02 13980

(51) Int. Cl.
*G09G 3/30* (2006.01)

(52) U.S. Cl. ..... 345/77; 345/82

(58) Field of Classification Search ..... 345/76–88, 345/204, 206, 94; 315/169.3
See application file for complete search history.

(56) References Cited

U.S. PATENT DOCUMENTS

| | | | | |
|---|---|---|---|---|
| 4,523,189 | A * | 6/1985 | Takahara et al. | 345/80 |
| 5,990,629 | A * | 11/1999 | Yamada et al. | 315/169.3 |
| 6,350,996 | B1 | 2/2002 | Kawai et al. | 257/88 |
| 2003/0067266 | A1 * | 4/2003 | Kim et al. | 313/504 |

FOREIGN PATENT DOCUMENTS

| | | |
|---|---|---|
| EP | 1251720 | 10/2002 |
| FR | 2.037.158 | 12/1970 |

* cited by examiner

*Primary Examiner*—Ricardo Osorio
*Assistant Examiner*—Mansour M. Said
(74) *Attorney, Agent, or Firm*—Joseph J. Laks; Harvey D. Fried; Patricia A. Verlangier

(57) ABSTRACT

Panel comprising an array of electroluminescent cells that are placed on a substrate, at least a first and a second array of electrodes (1,6); each cell comprises an organic electroluminescent layer (5) and a p-n-p-n or n-p-n-p junction (2) that are connected in series between an electrode of the first array and an electrode of the second array.

The bistable panel obtained is inexpensive and insensitive to ambient light.

8 Claims, 4 Drawing Sheets

BISTABLE ORGANIC ELECTROLUMINESCENT PANEL IN WHICH EACH CELL INCLUDES A SHOCKLEY DIODE

1/BACKGROUND OF THE INVENTION

The invention relates to an electroluminescent image display panel with a memory effect, to a device comprising this panel and to a method of driving this panel in order to display images.

Electroluminescent panels comprising an array of electroluminescent cells placed on a semiconductor substrate, for example based on polycrystalline silicon, are known; such panels are generally active-matrix panels.

Electroluminescent panels called "bistable" or "memory effect" panels are known in which each electroluminescent cell:

- may be switched from a stable OFF state to a stable ON state in response to a selective activation voltage address signal, or vice versa in response to an erase voltage address signal; and
- may be maintained in the OFF or ON state in which it has been placed by this address signal, by applying a voltage called a sustain voltage, which is identical to all the cells of the panel.

Documents U.S. Pat. No. 4,035,774—IBM , U.S. Pat. No. 4,808,880—CENT and U.S. Pat. No. 6,188,175 B1—CDT disclose panels of this type, in which each cell includes an organic electroluminescent layer and a photoconducting layer that are stacked and connected in series.

Document FR 2 037 158 describes a panel of this type, in which each cell includes a light-emitting diode and a p-n-p-n junction that are connected in series. The drawback of the panel disclosed in that document is that it has to be driven by means of three arrays of electrodes; this is because the devices described in FIGS. 3 and 4 of that document comprise:

- an array of common electrodes that connects one of the terminals of each light-emitting diode to the terminals (positive terminals) of the generators 20 and 21 (FIG. 3) or 51 and 54 (FIG. 4);
- an array of electrodes serving only for addressing (i.e. the switching of the state of the p-n-p-n junctions) that connects one of the terminals of each p-n-p-n junction directly to the selection means 23 or 53;
- an array of electrodes serving only for sustaining (i.e. the supply of the cells after addressing) that connects the same terminal of each p-n-p-n junction to the selection means 23 or 53, via a charge limitation resistor.

The panels described in document FR 2 037 158 therefore comprise three arrays of electrodes.

2/SUMMARY OF THE INVENTION

It is an object of the invention to simplify the structure of panels provided with p-n-p-n junctions; it is another object to provide drive means suitable for these simplified panels.

For this purpose, the subject of the invention is an image display panel comprising an array of electroluminescent cells placed on a substrate, a first and a second array of electrodes, in which each cell includes an organic electroluminescent layer and a p-n-p-n or n-p-n-p junction connected in series between an electrode of the first array and an electrode of the second array, in which, for each cell, no electrode of the said panel is connected directly to an n-type intermediate sublayer or to a p-type intermediate sublayer of the said junction.

Such junctions are designed to operate as Shockley diodes; a novel type of bistable panel is thus obtained.

The n-type or p-type intermediate sublayers correspond, in an n1-p1-n2-p2 stack, to the sublayers p1 and n2, or, in a p'1-n'1-p'2-n'2 stack, to the sublayers n'1 and p'2; in conventional p-n-p-n or n-p-n-p junctions, such intermediate sublayers may serve as "triggers" for setting the state—on or off—of the junction, something which is not at all the case in the invention; this is because, according to the invention, these sublayers are not connected to each electrode of the panel, thereby considerably simplifying the fabrication of the panel.

The planes of the n-p or p-n interfaces of the junctions may be parallel to the plane of the emissive surfaces of the various cells or perpendicular to the said plane.

Such a bistable panel has major advantages over the panels of the prior art, in which the bistable effect is obtained by means of a photoconducting element within each cell; this is because:

- the memory effect obtained is independent of the ambient light; in the panels with photoconducting elements, these elements may be accidentally tripped by the effect of the ambient light; in the panels according to the invention, such a risk is completely eliminated; and
- such a panel does not require shunts at the terminals of the electroluminescent elements, nor at the terminals of the p-n-p-n or n-p-n-p junction; such a panel does not require an amplification layer.

Unlike the panel described in the aforementioned FR 2 037 158, the panel therefore comprises here only two arrays of electrodes; a bistable memory-effect panel is therefore obtained with only two arrays of electrodes, thereby considerably simplifying the fabrication of the panel.

In summary, the subject of the invention is a panel comprising an array of electroluminescent cells that are placed on a substrate, a first and a second array of electrodes, in which each cell includes an organic electroluminescent layer and a p-n-p-n or n-p-n-p junction that are connected in series between an electrode of the first array and an electrode of the second array, and in which no electrode of the panel is connected directly to an n-type intermediate sublayer or to a p-type intermediate sublayer of the p-n-p-n or n-p-n-p junctions.

Preferably, the p-n-p-n or n-p-n-p junctions of the various cells are electrically isolated from one another by isolating elements.

Preferably, each cell includes a charge injection element that is inserted between the said electroluminescent layer and the said junction.

Preferably, the said charge injection elements are opaque.

The subject of the invention is also a device for displaying images that are partitioned into pixels or subpixels, comprising a panel according to any one of the preceding claims, characterized in that it includes supply and drive means:

- suitable for applying, in succession to each electrode of the second array then in address phase, a signal called a write trigger signal $V_a$ and for applying, during this time, a signal called a sustained signal $V_S$ to the other electrodes of the second array then in sustain phase; and
- during application of a write signal $V_a$ to the said electrode of the second array, suitable for applying, simultaneously to the electrodes of the first array, a signal called a state signal, either $V_{Off}$ or $V_{On}$, depending on whether it is desired not to activate or to activate, respectively, the cell connected between the electrode of the first array in question and the said electrode of the second array during the subsequent sustain phase of this electrode of the second array.

According to a conventional method of driving matrix panels, the duration of the sustain phases between two address phases makes it possible to modulate the brightness of the cells of the panel and, in particular, to generate the grey levels necessary for displaying each image.

Preferably, if $V_T$ is the voltage at the terminals of a cell of the panel above which a cell in the unactivated or OFF state switches to the activated or ON state and if $V_D$ is the voltage at the terminals of a cell of the panel below which a cell in the activated or ON state switches to the unactivated or OFF state, the said supply and drive means are designed so that, since $V_{off}$ is greater than $V_{on}$:

$$V_a - V_{on} \geqq V_T \text{ and } V_a - V_{off} < V_T$$

$$V_S - V_{on} < V_T \text{ and } V_s - V_{off} > V_D.$$

Preferably, the supply and drive means are also suitable for simultaneously applying, during each address phase of an electrode of the second array, a signal $V_C$ called a compensation signal to the various electrodes of the first array, where $V_C = V_{Off}$ for the electrodes of the first array receiving a data signal $V_{on}$ during the said address phase and where $V_C = V_{on}$ for the electrodes of the first array receiving a data signal $V_{off}$ during the said address phase.

This therefore prevents the signals sent to the electrodes of the first array for addressing an electrode of the second array from also affecting the other electrodes of this second array while they are in sustain phase and consequently disturbing the level of brightness of the cells corresponding to these electrodes.

Preferably, the said supply and drive means are designed so that, during each address phase, the duration of application of the said compensation signal $V_C$ is approximately equal to the duration of application of the data signal $V_{on}$ or $V_{off}$.

3/BRIEF DESCRIPTION OF THE DRAWINGS

The invention will be more clearly understood on reading the description that follows, given by way of non-limiting example and with reference to the appended figures in which.

The figure showing timing diagrams does not take account of the scale of values so as to better reveal certain details that would not be clearly apparent if the proportions had been respected.

4/DESCRIPTION OF THE PREFERRED EMBODIMENTS

A panel according to one embodiment of the invention may be fabricated as follows:

1. deposition of a conducting film, for example one based on aluminium, on a substrate 7;

2. etching of the conducting film in order to obtain an array of row electrodes $Y_n$;

3. deposition, on the entire active surface of the substrate, of four superposed layers of semiconductor materials doped successively p-n-p-n so as to obtain a stack suitable for forming Shockley-type junctions; for example, superposed layers of a-Si are deposited by chemical vapour deposition (CVD), each of these layers being differently doped by a suitable choice of the nature of the deposition atmosphere gas;

4. deposition, on the entire active surface of the substrate, of charge injection material for the organic electroluminescent layer; preferably, an opaque material is chosen in order to prevent light from reaching the layers of the p-n-p-n junction;

5. etching of the layers deposited at steps 3 and 4 in order to form, in isolation at each pixel or subpixel, a p-n-p-n Shockley diode 2 and an injection layer element; a suitable selective etching process is used so that the etching stops on the aluminium electrode lines;

6. in order to isolate, by applying an electrical insulation 4 between the p-n-p-n junctions and the injection layer elements specific to each pixel or subpixel, deposition by Spin coating over the entire surface of an insulating layer of a photosensitive polymer followed by the production, in this layer, of apertures that define the emissive regions of each pixel; advantageously, applying this insulator allows the surface to be flattened in order to prepare for coating with the organic OLED multilayer;

7. conventional deposition, by evaporation, of organic electroluminescent layers on the entire surface, for example a conventional OLED multilayer of the CuPC/TPD/Alq3 type; in the case of a colour panel, a mask is used for selectively and successively depositing the three OLED multilayers for the various colours—red, green and blue;

8. formation of an array of column electrodes $X_p$ perpendicular to the row electrodes, by depositing transparent or semi-transparent conducting material, for example by depositing an LiF/Al/ITO multilayer; these electrodes may be formed by selective deposition through a mask; if the surface includes an array of topographical features, such as cathode separators, it is also possible to deposit such a multilayer on the entire surface so that it is partitioned by these features in order to form the electrodes; and 9. encapsulation of the whole assembly in a manner known per se.

Figure 6:
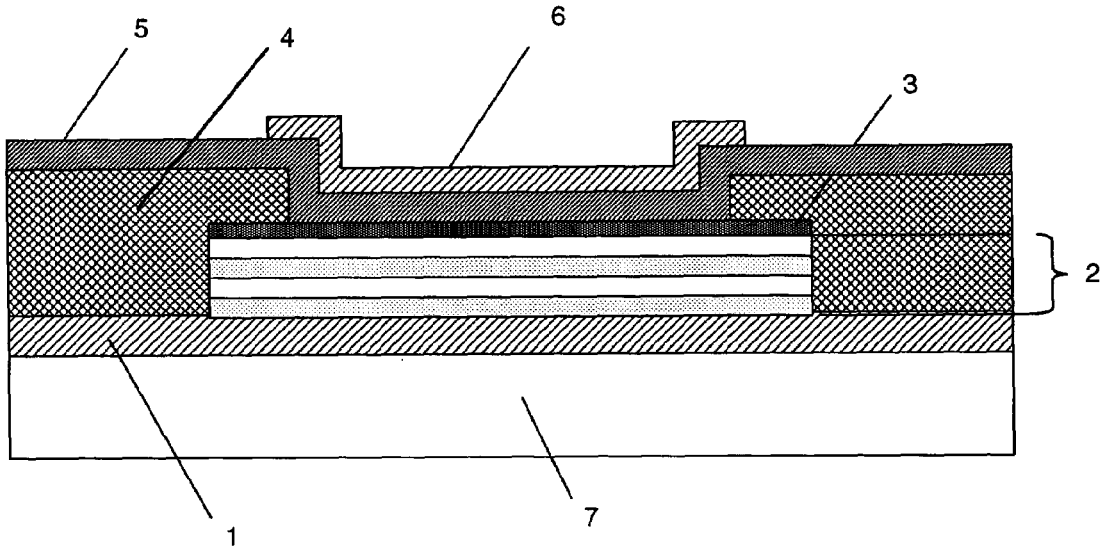
FIG. 6 is a schematic cross section of a cell of a panel according to one embodiment of the invention.

FIG. 6 shows a cross section of a cell of the panel obtained by this process, in which the various layers are referenced as follows:

1: aluminium row electrodes,

2: a-Si stack doped successively p-n-p-n;

3: conducting opaque charge injection layer;

4: polymer layer electrically isolating the cells from one another;

5: organic electroluminescent layer;

6: transparent or semi-transparent column electrode;

7: substrate.

Between the p-n-p-n junctions of the various cells, the layer 4 therefore forms isolating elements.

The charge injection layer 3 forms, at each cell, a charge injection element; the charge injection elements of the various cells are electrically isolated from one another by the isolating elements; these injection elements are not connected to any electrode of an array.

The plane of the n-p or p-n interfaces of the junctions of the panel obtained is in this case parallel to the plane of the emissive surfaces of the various cells in such a way that, for each cell, the p-n-p-n junction and the organic electroluminescent layer are stacked.

The memory effect obtained for each cell of this panel is designed to be able to use a procedure which, in succession for each row of cells of the panel, comprises an address phase, intended to turn on the cells to be turned on in this row, and then a sustain phase, intended to maintain the cells of this row in the state in which the previous address phase had placed or left them; while the cells of a row are in address phase, all the cells of the other rows of the panel are in sustain phase.

According to a conventional method of driving matrix panels, the duration of the sustain phases is used to modulate the brightness of the cells of the panel and, especially, to generate the grey levels needed to display each image.

A driving method, exploiting the memory effect of the cells of the panel, is therefore implemented:

- during the address phases, by applying, only to the terminals of the cells to be turned on, of a turn-on voltage $V_a - V_{on}$; and
- during the sustain phases, by applying, to the terminals of all the cells, a sustain voltage that may fluctuate but which must remain high enough for the cells previously turned on to remain turned on, and low enough not to risk turning on the cells previously turned off.

The address phase is therefore a selective phase; in contrast, the sustain phase is not selective, which makes it possible to apply the same voltage to the terminals of all the cells and considerably simplifies the way in which the panel is driven.

In practice, there are two large families of methods of driving such panels:

- either all the rows of the panel are addressed in succession, and then the sustain phase starts; the address and sustain phases are then separated in time;
- or, while a row, or even a group of rows, of the panel is being addressed, the other rows are in sustain phase; the address and sustain phases are therefore interlaced.

The first method, with separate address and sustain phases, has a drawback since no cell of the panel emits light during the address phases—the panel loses performance in terms of maximum brightness.

The invention relates to the most advantageous case from the standpoint of brightness in which the address and sustain phases are interlaced; the problem then is that the signals sent to the column electrodes, for addressing a row, also affect the other rows while they are in sustain phase and consequently disturb the brightness level of the cells corresponding to these rows; thus, the brightness level of the cells of a row is affected by the address signals sent to the other rows, which disturbs the image display quality.

The drive method according to the invention makes it possible to avoid this drawback by adding a compensation operation as explained below.

Figure 1:
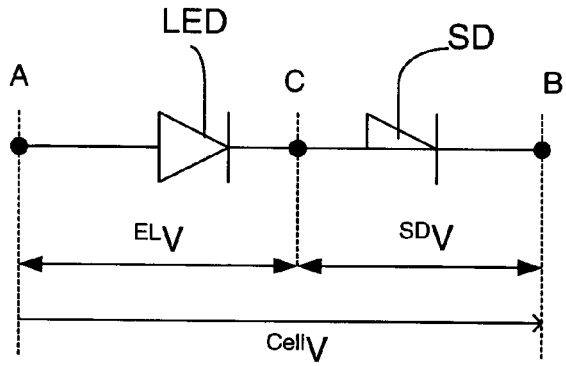
FIG. 1 illustrates the circuit diagram of a cell as shown in FIG. 6.

FIG. 1 shows the equivalent circuit diagram of a cell of the panel shown in FIG. 6, connected between a point A of an electrode of one of the arrays and a point B of an electrode of the other array; each cell of the panel may be electrically represented as a light-emitting diode LED connected in series with a p-n-p-n junction SD with a common point C.

We will now describe more precisely how the memory effect advantageously obtained in each cell of the panel operates.

Figure 2:
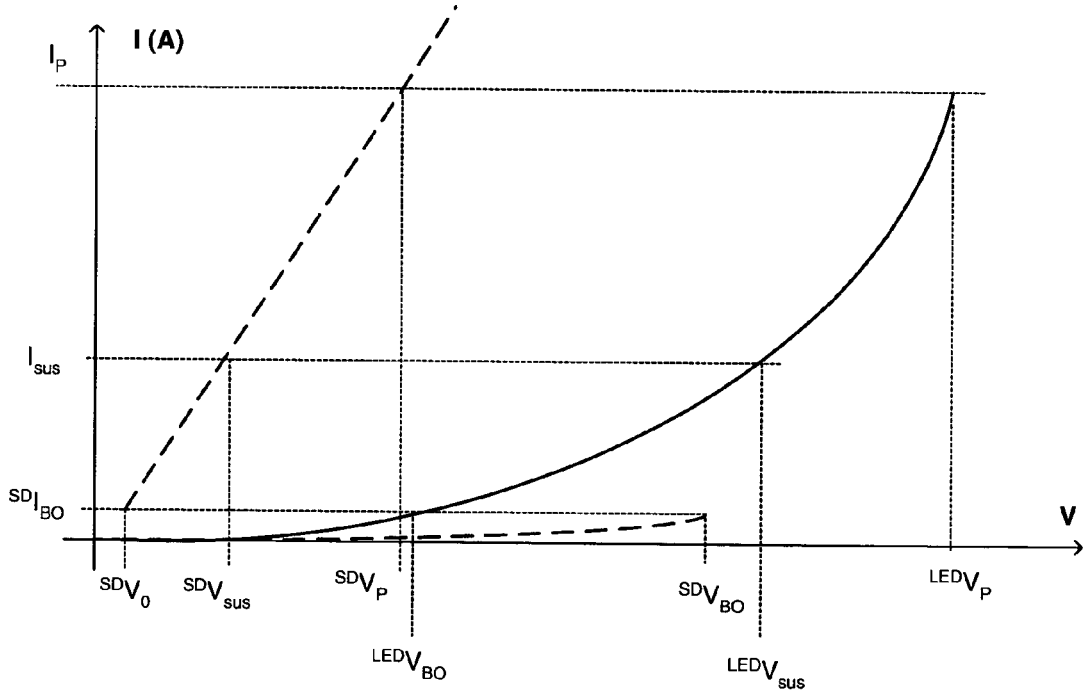
FIG. 2 shows the current-voltage characteristics of the two series-connected components of FIG. 1.

FIG. 2 shows the current(I)-voltage(V) characteristics of each of the two components LED and SD of a cell of the type shown in FIG. 1:

- the solid curve shows the conventional characteristics of a light-emitting diode of the OLED type;
- the dotted curve shows the conventional characteristics of a p-n-p-n junction operating as a Shockley-type diode, as described for example in the article: "*Physique des semi-conducteurs et des composants électroniques* [Physics of semiconductors and electronic components]", by Henry Mathieu, published by Masson , 4th edition, ISBN: 2-225-83151-3, 1997; at low voltage, this component has a very high impedance SDRH; above a breakover voltage ${}^{SD}V_{BO}$, the impedance of this junction suddenly drops to the level ${}^{SD}R_L << {}^{SD}R_H$; then, in the opposite direction, below what is called an extinction voltage ${}^{SD}V_0 << {}^{SD}V_{BO}$, the impedance of this junction greatly increases again to the initial level; at the moment of switch-over, in the rising direction or in the falling direction, the current in the junction is called ${}^{SD}I_{BO}$.

The low impedance ${}^{SD}R_L$ of the p-n-p-n junction in the conducting position is assumed to be small compared with that of the light-emitting diode LED for an applied voltage of the order of magnitude of that of the breakover voltage ${}^{SD}V_{BO}$; when the two components LED and SD are connected in series, the voltage at the terminals of the light-emitting diode when the p-n-p-n junction SD switches into the low-impedance conducting position is called ${}^{LED}V_{BO}$.

If ${}^{CELL}V$ is the voltage applied to the terminals of the series of the two components, then ${}^{CELL}V = {}^{SD}V + {}^{LED}V$ where:

$$ {}^{SD}V = {}^{SD}R_H / ({}^{SD}R_H + {}^{LED}R) \cdot {}^{CELL}V \quad \text{(R1)} $$

$$ {}^{LED}V = {}^{LED}R_H / ({}^{SD}R_H + {}^{LED}R) \cdot {}^{CELL}V \quad \text{(R2)} $$

where ${}^{LED}R$ is the dynamic resistance of the light-emitting diode.

If I is the intensity of the current in this series, the characteristic curve of this series may be separated into two operating regions that are separated by a transition region: a first operating region in the OFF state, in which $I < {}^{SD}I_{BO}$, a first transition OFF/ON region, in which I is close to ${}^{SD}I_{BO}$, a second operating region in the ON state, in which $I > {}^{SD}I_{BO}$, and a second transition ON/OFF region.

1. First operating region: $I < {}^{SD}I_{BO}$(OFF state)

The voltage at the terminals of the series is distributed between the components LED and SD according to the dynamic resistance of these components: thus ${}^{SD}V = {}^{SD}R_H \cdot I$ and ${}^{LED}V = {}^{LED}R_H \cdot I$.

in which ${}^{LED}R_H$ is the dynamic resistance of the light-emitting diode in the "high impedance" range corresponding to that in which the p-n-p-n diode is not conducting.

2. First transition region: OFF/ON switching of the p-n-p-n diode:

Let $V_T$ be the voltage applied to the terminals of the series at the moment of OFF/ON switching; there are in succession the following states:

- just before the switching to the ON state, ${}^{CELL}V = V_T - \epsilon'$ with ${}^{SD}V \approx {}^{SD}V_{BO}$ and $I = {}^{SD}I_{BO} - \epsilon$; since the cell is still in the OFF state, then, as previously, $V_T-\epsilon'=({}^{SD}R_H'({}^{SD}I_{BO}-\epsilon)$ and the voltage ${}^{LED}V_{BO}$ at the terminals of the diode is then ${}^{LED}R_H.({}^{SD}I_{BO}$;

just after the switching to the ON state, ${}^{CELL}V=V_T+\epsilon'$; since the cell i the ON state, then ${}^{SD}V=V_0<<{}^{SD}V_{BO}$.

The current I would then be ${}^{SD}I_{BO}+\epsilon$; the voltage ${}^{SD}V$ would then be ${}^{SD}R_L$. I and, if the light-emitting diode LED accommodates the entire impedance variation of the SD junction, then: ${}^{LED}V={}^{LED}R_H.\ I+({}^{SD}R_H-{}^{SD}R_L).I$.

However, this operating point is not stable and the current I in the series will increase to a value $I_P>{}^{SD}I_{BO}$ such that $V_T+\epsilon'=({}^{SD}R_L+{}^{LED}R_L).\ I_P$, the dynamic resistance of the light-emitting diode in the "low impedance" range corresponding to that in which the p-n-p-n diode is conducting and in which ${}^{LED}R_L<{}^{LED}R_H$.

Thus, ${}^{SD}V={}^{SD}V_P={}^{SD}R_L.I_P$ and ${}^{LED}V={}^{LED}V_P={}^{LED}R_L.\ I_P$.

3. Second operating region: $I>{}^{SD}I_{BO}$(ON state):

It has been found that the voltage ${}^{CELL}V$ at the terminals of the series may be reduced to below the OFF/ON switching value $V_T$, while maintaining the series in the ON state; the intensity of the current then drops to below $I_P$ while remaining above $I_{BO}$.

4. Second transition region: ON/OFF switching of the p-n-p-n diode:

The voltage applied to the terminals of the series at the moment of ON/OFF switching is called $V_D$; thus $V_D={}^{SD}V_0+{}^{LED}V_{BO}$.

As the system has two operating ranges, it is referred to as a bistable system.

It should be noted here that a current I flows through the light-emitting diode LED whatever the impedance of the Shockley diode SD: there is therefore light emission in the two states of the system; however, the current variations in the OFF/ON or ON/OFF transition regions are large enough to induce light intensity variations suitable for the contrast needed to display images.

For an intermediate voltage ${}^{CELL}V=V_S$ such that $V_D<V_S<V_T$, the diode therefore emits a large amount of light; if ${}^{SD}V_{SUS}$ is then the voltage at the terminals of the p-n-p-n junction and ${}^{LED}V_{SUS}$ the voltage at the terminals of the light-emitting diode, then $V_S={}^{SD}V_{sus}+{}^{LED}V_{sus}$.

Figure 3:
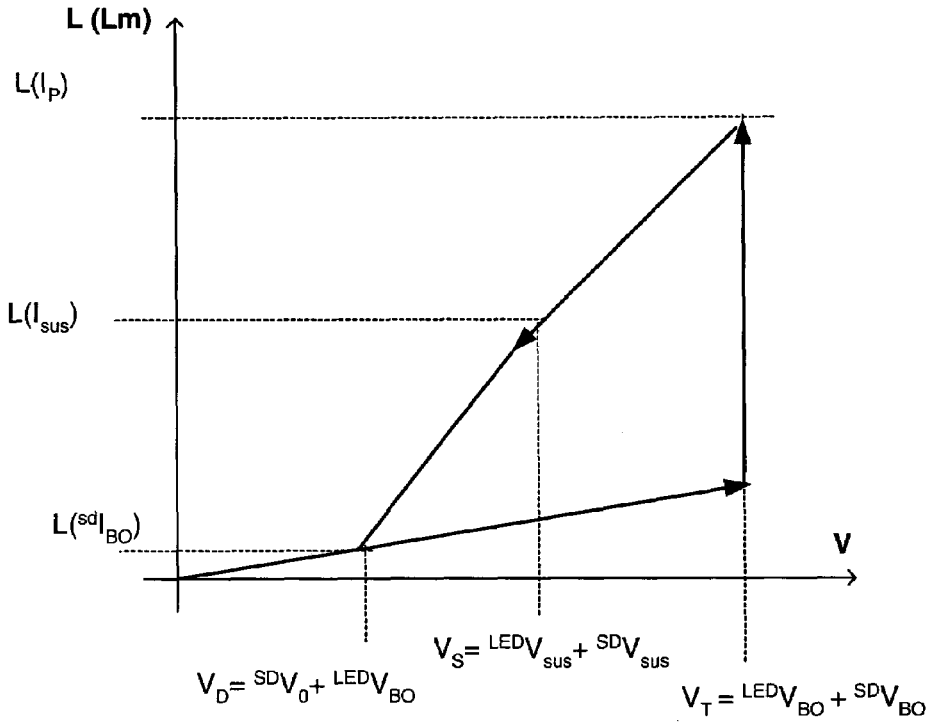
FIG. 3 shows the variation in the light intensity emitted by the cell of FIGS. 1 and 6 during a cycle of applying voltage to the terminals of this cell.
Figure 4:
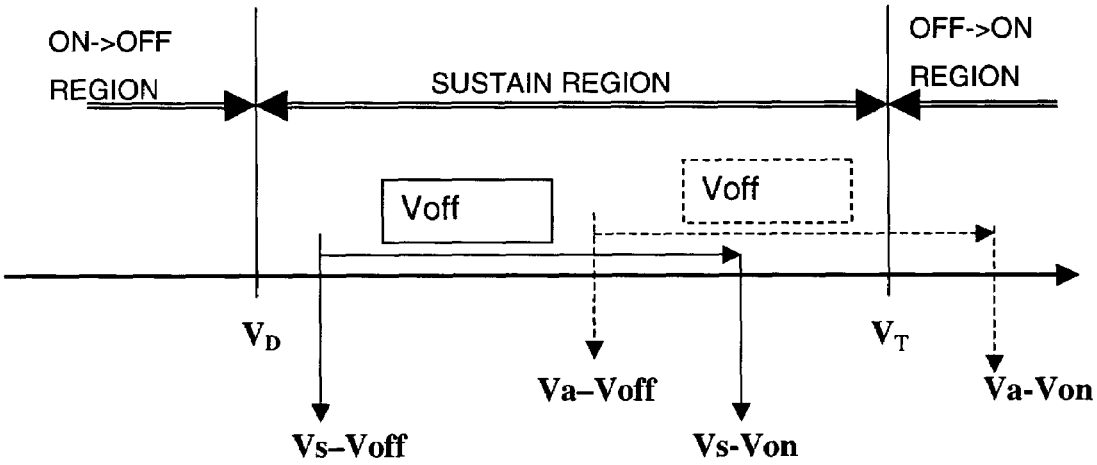
FIG. 4 shows the various voltages applied to the terminals of this cell when a drive method as shown in FIG. 5 is used.

FIG. 3 illustrates the intensity of light emission by the diode for the cycle corresponding to an increasing voltage and then a decreasing voltage applied to the terminals of the series of the two components that have just been described; this figure clearly corresponds to a conventional bistable operation; the structure of the cell according to the invention, as shown in FIG. 6, does indeed provide the desired memory effect.

The memory effect obtained when a drive method of the aforementioned type is applied to an electroluminescent panel according to the invention will now be described more precisely.

Figure 5:
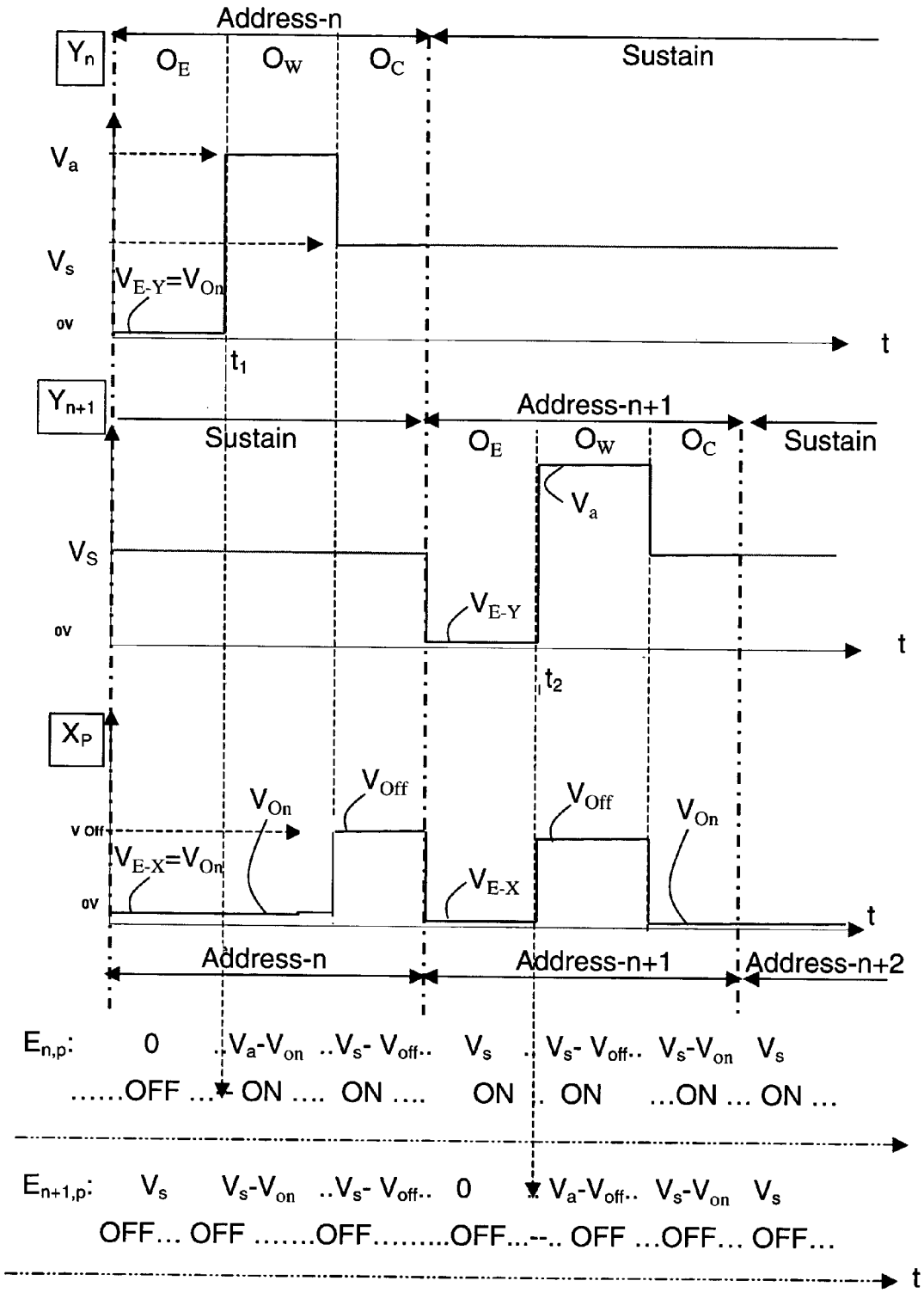
FIG. 5 shows the timing diagrams of the voltages applied to two row electrodes $Y_n$ and $Y_{n+1}$ and to a column electrode $X_p$ of a panel according to the invention provided with cells such as those shown in FIGS. 1 and 6 connected to these electrodes.

FIG. 5 illustrates, according to this conventional drive method:

a cell $E_{n,p}$ supplied between the electrode of the row n and the electrode of the column p of the panel, a complete address phase "address-n" with ignition of this cell, which remains lit for $t>t_1$, for a cell $E_{n+1,p}$ of the next row "address-n+1", a complete address phase, without turning on this cell, which remains off for $t>t_2$.

The three timing diagrams $Y_n$, $Y_{n+1}$, $X_p$ indicate the voltages applied to the row electrodes $Y_n$, $Y_{n+1}$ and to the column electrode $X_p$ in order to obtain these sequences.

According to the invention and with reference to FIG. 5, each address phase comprises, in succession, an erase operation $O_E$, a write operation $O_W$, and a compensation operation $O_C$.

The bottom of FIG. 5 indicates the potential values $E_{n,p}$, $E_{n+1,p}$ at the terminals of the cells and the ON state or OFF state of these cells.

The panel according to the invention is provided with supply and drive means suitable for being able to deliver the following signals to the electrodes:

in the case of the row electrodes, either an erase voltage $V_{E-Y}$ or a write trigger voltage $V_a$, or a sustain voltage $V_S$;

in the case of the column electrodes, either a data activation voltage $V_{on}$ or a data non-activation voltage $V_{off}$ or a data erase voltage $V_{E-X}$.

To produce such supply means is within the competence of a person skilled in the art and will not be described here in detail.

To obtain the ON or OFF states indicated at the bottom of FIG. 5, it is therefore necessary that, by applying, to the terminals of a cell as shown in FIG. 1:

a potential difference $(V_a-V_{on})$ to a cell in the OFF state, this cell switches to the ON state;

a potential difference $(V_s-V_{on})$, $(V_s-V_{off})$, or $(V_a-V_{off})$ to a cell in the ON state or in the OFF state, this cell remains in the ON state or in the OFF state, respectively; and a potential difference $(V_{E-Y}-V_{E-X})$ to a cell in the ON state, this cell switches to the OFF state.

To obtain the desired memory effect, the drive method applied to the panel according to the invention must be designed so that the values of the signals described above with reference to FIG. 5, that are applied to the row and column electrodes, satisfy the relationships:

$$(V_a-V_{on})>V_T,$$

$$V_D<(V_s-V_{on}),\ V_D<(V_s-V_{off}),\ \text{and}\ (V_a-V_{off})<V_T,$$

$$(V_{E-Y}-V_{E-X})<V_D.$$

Preferably, to simplify the supply and drive means for the panel, $V_{on}$ is taken to be equal to zero.

Before each operation $O_W$ of writing to a row $Y_n$ of the panel, an erase operation $O_E$ is generally carried out, which consists in applying erase signals $V_{E-Y}$ and $V_{E-X}$ to the address and sustain electrode and to the data electrodes, respectively; it is necessary to choose $V_{E-Y}-V_{E-X}<V_D$ so as to turn off all the cells that are supplied by the said address and sustain electrode; in general, as illustrated in FIG. 5, to simplify the supply and drive means, the voltages will be chosen so that $V_{E-Y}=V_{E-X}=V_{on}$.

During each write operation $O_W$ for writing to a row $Y_n$ of the panel, the average value of the signals sent to the various columns X1, . . . , Xp, . . . depends on the number of cells to be activated or not activated in this row $Y_n$; during this write operation, all the other rows of the panel are in sustain phase and the activated cells of these rows are supplied by the potential difference between the potential $V_s$ applied to these rows and the potential $V_{on}$ or $V_{off}$ applied to the column electrodes $X_p$; it may therefore be seen that the potential difference at the terminals of the cells in the sustain phase varies depending on the columns to which they belong: $V_s-V_{on}$, or $V_s-V_{off}$; consequently, the light power emitted by the cells of the other rows will, in the column to which they belong, vary depending on whether or not the cell of the row $Y_n$ is to be activated.

The compensation operation $O_C$ that follows each write operation makes it possible to avoid this drawback: as illustrated in FIG. 5, this operation consists in applying a voltage $V_{Off}$ to the columns X that received a data signal $V_{on}$ during the previous write operation $O_W$, or a signal $V_{on}$ to the columns X that received a data signal $V_{off}$ during the previous write operation $O_W$; furthermore, if the duration of application of this compensation signal is approximately equal to the duration of application of the prior data signal $V_{on}$ or $V_{off}$, it may be stated that, by integrating the duration of a write operation and that of a compensation operation, all the columns receive on average the same potential whatever the row addressed and whatever the number of cells to be activated or not activated in these rows, thereby making it possible to avoid the aforementioned drawback; these compensation operations, which according to the invention are incorporated into the address phases, make it possible to ensure emission homogeneity of the unaddressed pixels of the panel.

We have therefore shown how the electroluminescent panel according to the invention may be advantageously driven, in a very simple manner, by virtue of the memory effect obtained and, preferably, by adding a compensation operation in the address phases.

The present invention has been described with reference to an electroluminescent panel in which each cell corresponds to FIG. 6; however, it is obvious to those skilled in the art that it may apply to other types of panel without departing from the scope of the claims appended hereto.

In particular, an n-p-n-p junction may be used instead of the p-n-p-n junction described above; it will then be necessary to convert the anode layer and the cathode layer during fabrication of the panel; in other words, if the anode layer is deposited firstly on the Shockley diodes, junctions of the p-n-p-n type, as described above, will be chosen; in contrast, if the cathode layer is deposited firstly on the Shockley diodes, junctions of the n-p-n-p type will be chosen.

The invention claimed is:

1. Image display panel comprising an array of electroluminescent cells that are placed on a substrate, a first and a second array of electrodes, in which each cell includes an electroluminescent layer and a p-n-p-n or n-p-n-p junction connected in series between an electrode of the first array and an electrode of the second array, in which, for each cell, no electrode of the said panel is connected directly to an n-type intermediate sublayer or to a p-type intermediate sublayer of the said junction, characterized in that the said electroluminescent layer is organic and in that the said panel comprises only two arrays of electrodes.

2. Panel according to claim 1, characterized in that the p-n-p-n or n-p-n-p junctions of the various cells are electrically isolated from one another by isolating elements.

3. Panel according to claim 1, characterized in that each cell includes a charge injection element that is inserted between the said electroluminescent layer and the said junction.

4. Panel according to claim 3, characterized in that the said charge injection elements are opaque.

5. Device for displaying images partitioned into pixels or subpixels, comprising a panel according to claim 1, characterized in that it includes supply and drive means:

suitable for applying, in succession to each electrode of the second array then in address phase, a signal called a write trigger signal $V_a$ and for applying, during this time, a signal called a sustained signal $V_S$ to the other electrodes of the second array then in sustain phase; and during application of a write signal $V_a$ to the said electrode of the second array, suitable for applying, simultaneously to the electrodes of the first array, a signal called a state signal, either $V_{Off}$ or $V_{On}$, depending on whether it is desired not to activate or to activate, respectively, the cell connected between the electrode of the first array in question and the said electrode of the second array during the subsequent sustain phase of this electrode of the second array.

6. Device according to claim 5, characterized in that, if $V_T$ is the voltage at the terminals of a cell of the panel above which a cell in the unactivated or OFF state switches to the activated or ON state and if $V_D$ is the voltage at the terminals of a cell of the panel below which a cell in the activated or ON state switches to the unactivated or OFF state, the said supply and drive means are designed so that, since $V_{off}$ is greater than $V_{on}$:

$$V_a - V_{on} \geqq V_T \text{ and } V_a - V_{off} < V_T$$

$$V_S - V_{on} < V_T \text{ and } V_s - V_{off} > V_D.$$

7. Device according to either of claims 5, characterized in that the supply and drive means are also suitable for simultaneously applying, during each address phase of an electrode of the second array, a signal $V_C$ called a compensation signal to the various electrodes of the first array, where $V_C = V_{Off}$ for the electrodes of the first array receiving a data signal $V_{on}$ during the said address phase and where $V_C = V_{on}$ for the electrodes of the first array receiving a data signal $V_{off}$ during the said address phase.

8. Device according to claim 7, characterized in that the said supply and drive means are designed so that, during each address phase, the duration of application of the said compensation signal $V_C$ is approximately equal to the duration of application of the data signal $V_{on}$ or $V_{off}$.

* * * * *